United States Patent [19]

Kindt

[11] Patent Number: 4,513,959

[45] Date of Patent: Apr. 30, 1985

[54] SHEET DECELERATION APPARATUS

[75] Inventor: Robert J. Kindt, Rochester, N.Y.

[73] Assignee: Eastman Kodak Company, Rochester, N.Y.

[21] Appl. No.: 438,995

[22] Filed: Nov. 4, 1982

[51] Int. Cl.[3] ..... B65H 5/34

[52] U.S. Cl. ..... 271/270; 188/67; 188/166; 198/624; 271/69; 271/202; 271/272

[58] Field of Search ..... 271/69, 314, 270, 272, 271/273, 274, 202, 182, 183, 229, 230, 231; 198/624; 188/75, 67, 166

[56] References Cited

U.S. PATENT DOCUMENTS

| | | | |
|---|---|---|---|
| 1,736,482 | 11/1929 | Broadmeyer | 271/176 |
| 1,752,681 | 4/1930 | Maxson | 271/182 |
| 2,924,453 | 2/1960 | Peyrebrune | 271/79 |
| 3,507,489 | 4/1970 | Wilshin et al. | 271/182 |
| 3,672,667 | 6/1972 | Pahlitzsch | 271/74 |
| 4,040,617 | 8/1977 | Walkington | 271/177 |
| 4,184,392 | 1/1980 | Wood | 271/69 |

*Primary Examiner*—Bruce H. Stoner, Jr.
*Assistant Examiner*—John A. Carroll
*Attorney, Agent, or Firm*—Larry P. Kessler

[57] ABSTRACT

Apparatus for decelerating a sheet moving at a predetermined linear speed along a travel path. The apparatus, located in juxtaposition with the sheet travel path, engages a sheet traveling along such path to apply a deceleration force to such sheet. The deceleration force imparted to such sheet is progressively increased to gradually slow the linear speed of such sheet from the predetermined linear speed to a lesser linear speed.

9 Claims, 5 Drawing Figures

SHEET DECELERATION APPARATUS

BACKGROUND OF THE INVENTION

This invention relates generally to sheet feeding apparatus, and more particularly to apparatus for decelerating a moving sheet.

In sheet feeding apparatus, it is common practice to transport a sheet at different linear speeds in various portions of the apparatus. The transition between linear speeds typically must be accomplished rapidly without damage to a transported sheet. An example of a speed transition apparatus for decelerating a transported sheet is shown in U.S. Pat. No. 3,507,489 issued Apr. 21, 1970 in the names of Wilshin et al. In the apparatus shown in such patent, an idler roller is actuated to urge a sheet moving at a first linear speed into engagement with a decelerating (retarding) member, such as a belt or roller, having a second linear speed less than the first linear speed. The deceleration of a transported sheet is then accomplished by the interaction between such sheet and the retarding member. Such interaction can damage the sheet. Further, the apparatus of such patent requires an external mechanism for sensing the presence of a sheet to be decelerated and actuating the idler roller to effect the deceleration. Such external sensing mechanism complicates the structure of the apparatus and has an adverse effect on its reliability.

SUMMARY OF THE INVENTION

This invention is directed to apparatus for decelerating a sheet moving at a predetermined linear speed along a travel path. The apparatus, located in juxtaposition with the sheet travel path, engages a sheet traveling along such path to apply a deceleration force to such sheet. The deceleration force imparted to such sheet is progressively increased to gradually slow the linear speed of such sheet from the predetermined linear speed to a lesser linear speed.

The invention, and its objects and advantages, will become more apparent in the detailed description of the preferred embodiment presented below.

BRIEF DESCRIPTION OF THE DRAWINGS

In the detailed description of the preferred embodiment of the invention reference is made to the accompanying drawing, in which.

DESCRIPTION OF THE PREFERRED EMBODIMENT

Figure 1:
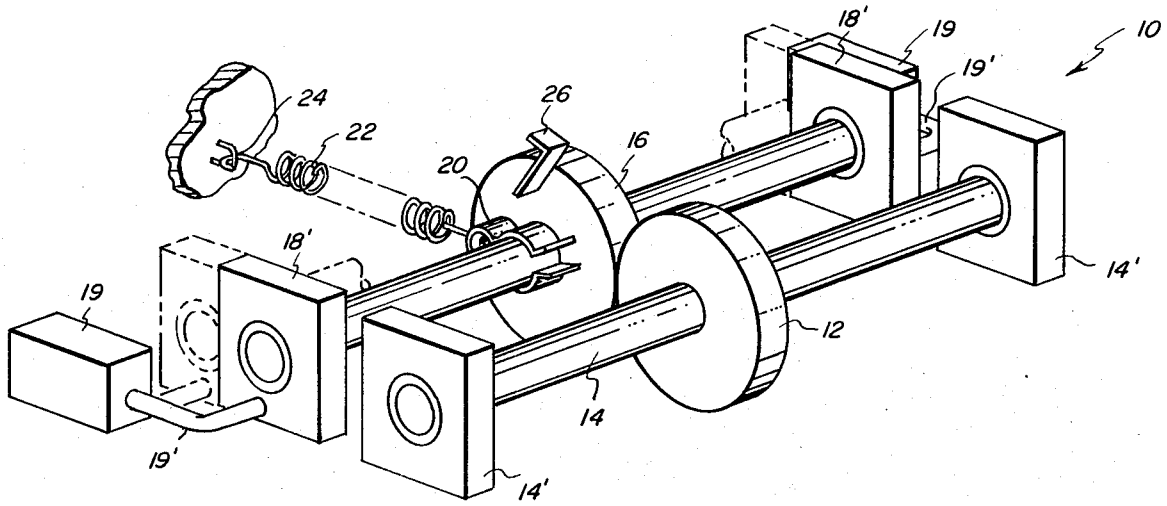
FIG. 1 is a view, in perspective, of the sheet deceleration apparatus according to this invention.
Figure 2:
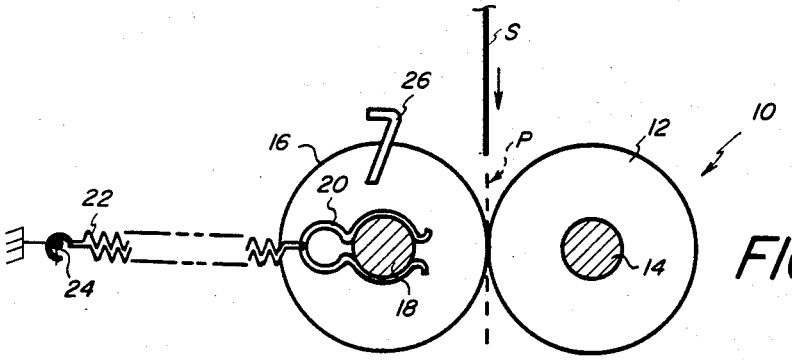
FIG. 2 is a side elevational view of the sheet deceleration apparatus of FIG. 1.
Figure 3:
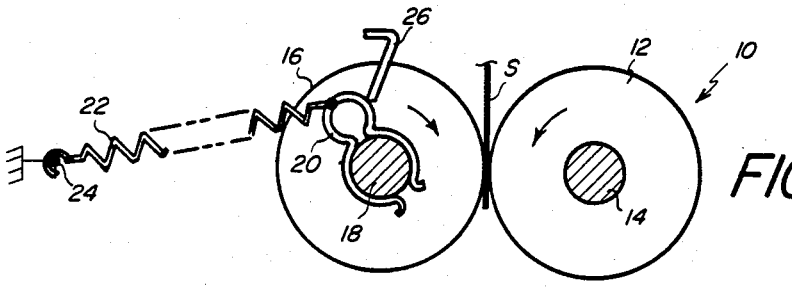
FIG. 3 is a side elevational view of the apparatus of FIG. 2 decelerating a sheet.
Figure 4:
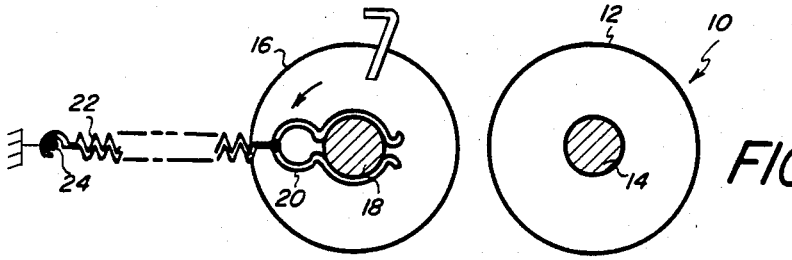
FIG. 4 is a side elevational view of the apparatus of FIG. 2 positioned to release a decelerated sheet.

Refering now to the accompanying drawings, the sheet deceleration apparatus of this invention is designated generally in FIGS. 1 through 4 by the numeral 10. The apparatus 10 includes an idler roller 12 mounted on a shaft 14, and a deceleration roller 16 mounted on a shaft 18. The shafts 14 and 18 are respectively supported in spaced relation for rotation in bearing blocks 14' and 18' (see FIG. 1). The longitudinal axis of the shaft 14 is transverse to a travel path P for a sheet S (see FIG. 2), and spaced from such path so that the peripheral surface of the idler roller 12 is tangent to the path. The longitudinal axis of the shaft 18 is parallel to the axis of the shaft 14 on the opposite side of the path P. Solenoids 19, coupled to the blocks 18' through retractable arms 19' respectively, position the shaft 18. With the arms 19' extended, the shaft 18 is spaced from the path P so that the peripheral surface of the deceleration roller 16 is tangent to the path on the opposite side from the shaft 14 to form a nip between the rollers 12 and 16 (solid line position of FIG. 1). When the arms 19' are retracted, the shaft 18 is moved to its phantom line position to separate rollers 12 and 16.

A friction clutch 20 is mounted on the shaft 18. The clutch 20 is in the form of a spring clip frictionally engaging the shaft 18 for movement with the shaft. A tension spring 22 is connected at one end to the clutch 20 and at the opposite end to a fixed retainer 24 remote from the shaft 18. The spring 22 urges the clutch 20 toward its position shown in FIGS. 1 and 2. A stop member 26 is located adjacent to the shaft 18 in the path of movement of the clutch 20. The stop member 26 prevents rotation of the clutch 20 beyond its position shown in FIG. 3.

The operation of the sheet deceleration apparatus 10 is as follows: A sheet S is transported along the travel path P at a predetermined linear speed, designated as L in the graph of FIG. 5, by a drive mechanism (not shown). Such drive mechanism is, for example, driven nip rollers spaced from the apparatus 10 a distance greater than the sheet dimension measured along the travel path, the inertia of the sheet causing the sheet to travel from the drive mechanism to the nip between the idler roller 12 and the deceleration roller 16. As the sheet enters the nip between the rollers 12 and 16, the inertia of the sheet causes the normally at rest rollers to rotate about the axes of their respective shafts 14, 18 in the direction shown by the arrows in FIG. 3. The acceleration of the rollers results in a corresponding deceleration of the sheet.

Rotation of the roller 16 causes rotation of the shaft 18. The friction force between the clutch 20 and shaft 18 is greater than the force of the tension spring 22 on the clutch (determined by the spring constant of such spring). Thus the friction clutch 20 moves with the shaft 18 from its initial position shown in FIGS. 1 and 2 toward the position shown in FIG. 3. However, this movement stretches the tension spring 22, progressively increasing the force of the spring urging the clutch 20 towards its initial position. The increased urging force on the clutch 20 partially overcomes the friction force of the clutch on the shaft 18. This results in a progressive increased resistance to rotation of the shaft 18 (and roller 16) by the slipage of the clutch on the shaft. Accordingly the deceleration force exerted on the sheet S by the roller 16 correspondingly progressively increases. Although the friction force exerted on the shaft 18 by the clutch 20 is reduced upon slippage, it is greater than the force exerted by the spring 22 on the clutch, whereby the clutch rotates with the shaft to the position of FIG. 3. When the clutch 20 moves to the position where it engages the stop member 26 (FIG. 3), further rotation of the clutch is prevented. This further increases the deceleration force exerted on the sheet S by the roller 16 due to the braking (friction) force imparted to the shaft 18 by the relative rotation between clutch and the shaft. The linear speed of the sheet is thus gradually slowed from the predetermined linear to a lesser linear speed.

Figure 5:
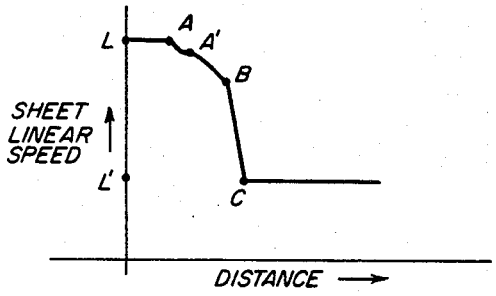
FIG. 5 is a graphical representation of the linear speed of a sheet being decelerated plotted as a function of distance of sheet travel through the deceleration apparatus according to this invention.

The profile of the linear speed of the sheet S is diagramatically represented by the graph of FIG. 5. The linear speed of the transported sheet prior to entering the deceleration apparatus 10 is designated as L. The linear speed of the sheet, from entering the nip between rollers 12, 16 until clutch 20 engages stop 26, is represented by the line from point A to point B. The intermediate point A′ represents the distance the sheet travels before the inertia of the rollers is overcome and the rollers rotate at a peripheral speed equal to the linear speed of the sheet. The slope of the line between points A and A′ is greater than the slope of the line between points A′ and B, over which distance the spring 22 is effective to progressively increase the deceleration force. The linear speed of the sheet from the engagement of the clutch 20 with stop 26 to the slower linear speed, designated L′, is represented by the line between point B and point C. The linear speed L′ is determined by the friction force of the clutch 20 on the shaft 18. Accordingly, to obtain any desired slower linear sheet speed (including fully stopped), a clutch exerts a proportional frictional engagement force on the shaft 18; that is, the slower the desired linear sheet speed, the greater the required frictional engagement force of the clutch on the shaft. As will be appreciated, the described deceleration of the sheet S occurs automatically as the sheet engages the rollers 12, 16. There is no need to positiviely activate the apparatus 10 by an external sheet position sensor, as required in the prior art.

After a predetermined time interval sufficient for the sheet S to be decelerated to the slower linear speed L′, solenoids 19 are actuated to retract arms 19′ to move shaft 18 away from shaft 14 (to the left in FIG. 4) to the phantom line position of FIG. 1. Such movement separates the rollers 12 and 16 to release the sheet for transport away from the apparatus 10 by a drive mechanism (not shown), such as drive nip rollers downstream of the apparatus 10 for example. When the rollers are separated, the spring 22 returns the clutch 20 to its intitial position. After a predetermined time interval sufficient for the sheet to leave the apparatus 10, the solenoids 19 are actuated to extend arms 19′ to move shaft 18 to return the roller 16 into contact with the roller 12 (to the right in FIG. 4). The apparatus is thus ready to act on the next sheet entering the nip between such rollers.

The invention has been described in detail with particular reference to a preferred embodiment thereof, but it will be understood that variations and modifications can be effected within the spirit and scope of the invention.

I claim:

1. Apparatus for decelerating a sheet moving at a predetermined linear speed along a travel path, said apparatus comprising:

means, located in juxtaposition with the sheet travel path, for engaging a sheet traveling along such path, said means being actuated by engagement of a sheet to apply a deceleration force to such sheet during such engagement; and means, operatively associated with said sheet engaging means and responsive to the engagement of a sheet by said sheet engaging means, for progressively increasing the deceleration force imparted to such sheet by said sheet engaging means to gradually slow the linear speed of such sheet from the predetermined linear speed to a lesser linear speed.

2. The invention of claim 1 wherein said sheet engaging means includes an idler roller located in juxtaposition with the sheet travel path, and a deceleration roller rotatably mounted in juxtaposition with the sheet path on the opposite side of such path from said idler roller forming a nip therebetween.

3. The invention of claim 2 wherein said deceleration roller is mounted on a shaft; and wherein deceleration force increasing means comprises a friction clutch supported by said shaft, means for urging said friction clutch in a direction opposite to the direction of rotation with said shaft to progressively increase the deceleration force imparted to said shaft by said clutch, and means operatively engageable with said friction clutch after a degree of rotation of such clutch for preventing further rotation of such clutch.

4. The invention of claim 3 wherein said friction clutch comprises a spring clip mounted in frictional engagement on said shaft.

5. The invention of claim 3 wherein said friction clutch urging means comprises a tension spring connected at one end to said friction clutch and at the opposite end to a fixed retainer remote from said clutch.

6. The invention of claim 2, further including means for separating said deceleration roller and said idler roller, after such sheet is slowed to such lesser linear speed, to release such sheet whereby such sheet is then freely movable away from such rollers.

7. Apparatus for decelerating a sheet moving at a predetermined linear speed along a travel path, said apparatus comprising:

a pair of rotatable rollers located in juxtaposition with the sheet travel path on opposite sides of such path to form a sheet engaging nip therebetween, said rollers being rotatably driven by a moving sheet as it passes through such nip;

means, operatively associated with one roller of said pair of rollers and responsive to drive of said rollers by a sheet, for imparting a progressively increasing deceleration force to such sheet by progressively retarding rotation of such one roller to gradually slow the linear speed of such sheet from the predetermined linear speed to a lesser linear speed.

8. The invention of claim 7 further including a shaft, such one roller mounted for rotation on said shaft; and wherein said deceleration force imparting means comprises a friction clutch supported by said shaft, means for urging said friction clutch in a direction opposite to the direction of rotation with said shaft to progressively increase the deceleration force imparted to said shaft by said clutch, and means operatively engageable with said friction clutch after a degree of rotation of such clutch for preventing further rotation of such clutch.

9. The invention of claim 8 further including means for moving said shaft after such sheet is slowed to such lesser linear speed, to separate such one roller from the other roller of said pair of rollers, whereby such sheet is released for free movement away from such rollers.

* * * * *